US009798274B2

(12) United States Patent
Hayashi et al.

(10) Patent No.: US 9,798,274 B2
(45) Date of Patent: Oct. 24, 2017

(54) PREHEATING DEVICE AND IMAGE FORMING APPARATUS

(71) Applicant: FUJI XEROX Co., Ltd., Tokyo (JP)

(72) Inventors: Yoshihiro Hayashi, Kanagawa (JP); Mizuki Sugino, Kanagawa (JP); Toshinori Sasaki, Kanagawa (JP); Koichi Kimura, Kanagawa (JP); Mitsutoshi Hongo, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/228,041

(22) Filed: Aug. 4, 2016

(65) Prior Publication Data

US 2017/0255137 A1 Sep. 7, 2017

(30) Foreign Application Priority Data

Mar. 1, 2016 (JP) ..... 2016-039295

(51) Int. Cl.
*G03G 15/20* (2006.01)

(52) U.S. Cl.
CPC ..... *G03G 15/2021* (2013.01); *G03G 15/2028* (2013.01)

(58) Field of Classification Search
None
See application file for complete search history.

(56) References Cited

U.S. PATENT DOCUMENTS 5,887,236 A * 3/1999 Hirao ..... G03G 15/2064 399/328
2011/0064468 A1* 3/2011 Kawahata ..... G03G 15/2053 399/122

FOREIGN PATENT DOCUMENTS

JP 2011-059636 A 3/2011

* cited by examiner

*Primary Examiner* — Thomas Giampaolo, II
(74) *Attorney, Agent, or Firm* — Sughrue Mion, PLLC

(57) ABSTRACT

A preheating device includes a heating member that is capable of heating a continuous medium, and a movement unit that moves at least one of the continuous medium and the heating member in a direction in which the continuous medium and the heating member move relatively closer to each other or in a direction in which the continuous medium and the heating member move relatively away from each other. The movement unit moves at least one of the continuous medium and the heating member in the direction in which the continuous medium and the heating member move relatively closer to each other if predetermined heating conditions are satisfied, and the movement unit moves at least one of the continuous medium and the heating member in the direction in which the continuous medium and the heating member move relatively away from each other if the heating conditions are not satisfied.

9 Claims, 6 Drawing Sheets

PREHEATING DEVICE AND IMAGE FORMING APPARATUS

CROSS-REFERENCE TO RELATED APPLICATIONS

This application is based on and claims priority under 35 USC 119 from Japanese Patent Application No. 2016-039295 filed Mar. 1, 2016.

BACKGROUND

The present invention relates to a preheating device and an image forming apparatus.

SUMMARY

According to an aspect of the invention, there is provided a preheating device for heating a continuous medium that is continuous in a transport direction in which the continuous medium is transported, the preheating device being disposed upstream of a fixing device in the transport direction, the fixing device fixing an image, which has been transferred to the continuous medium, to the continuous medium. The preheating device includes a heating member that is capable of heating the continuous medium by using heat supplied from a heat source, and a movement unit that moves at least one of the continuous medium and the heating member in a direction in which the continuous medium and the heating member move relatively closer to each other or in a direction in which the continuous medium and the heating member move relatively away from each other. On the basis of predetermined heating conditions, the movement unit moves at least one of the continuous medium and the heating member in the direction in which the continuous medium and the heating member move relatively closer to each other if the heating conditions are satisfied, and the movement unit moves at least one of the continuous medium and the heating member in the direction in which the continuous medium and the heating member move relatively away from each other if the heating conditions are not satisfied.

BRIEF DESCRIPTION OF THE DRAWINGS

Exemplary embodiments of the present invention will be described in detail based on the following figures, wherein.

DETAILED DESCRIPTION

Hereinafter, exemplary embodiments of the invention will be described with reference to the drawings. Note that the present invention is not limited to the exemplary embodiments described below.

To facilitate understanding the following description, the directions in the figures are defined as follows: the front-back direction is the X-axis direction, the left-right direction is the Y-axis direction, and the up-down direction is the Z-axis direction. The directions indicated by arrows X, −X, Y, −Y, Z, and −Z are respectively forward, backward, rightward, leftward, upward, and downward; or the front side, the back side, the right side, the left side, the upper side, and the lower side.

In each of the figures, a symbol "○" with "•" in it represents an arrow extending from the back side toward the front side of the plane of the figure, and a symbol "○" with "x" in it represents an arrow extending from the front side toward the back side of the plane of the figure.

In the figures, members that are not necessary for understanding the following descriptions are not illustrated.

First Exemplary Embodiment

Figure 1:
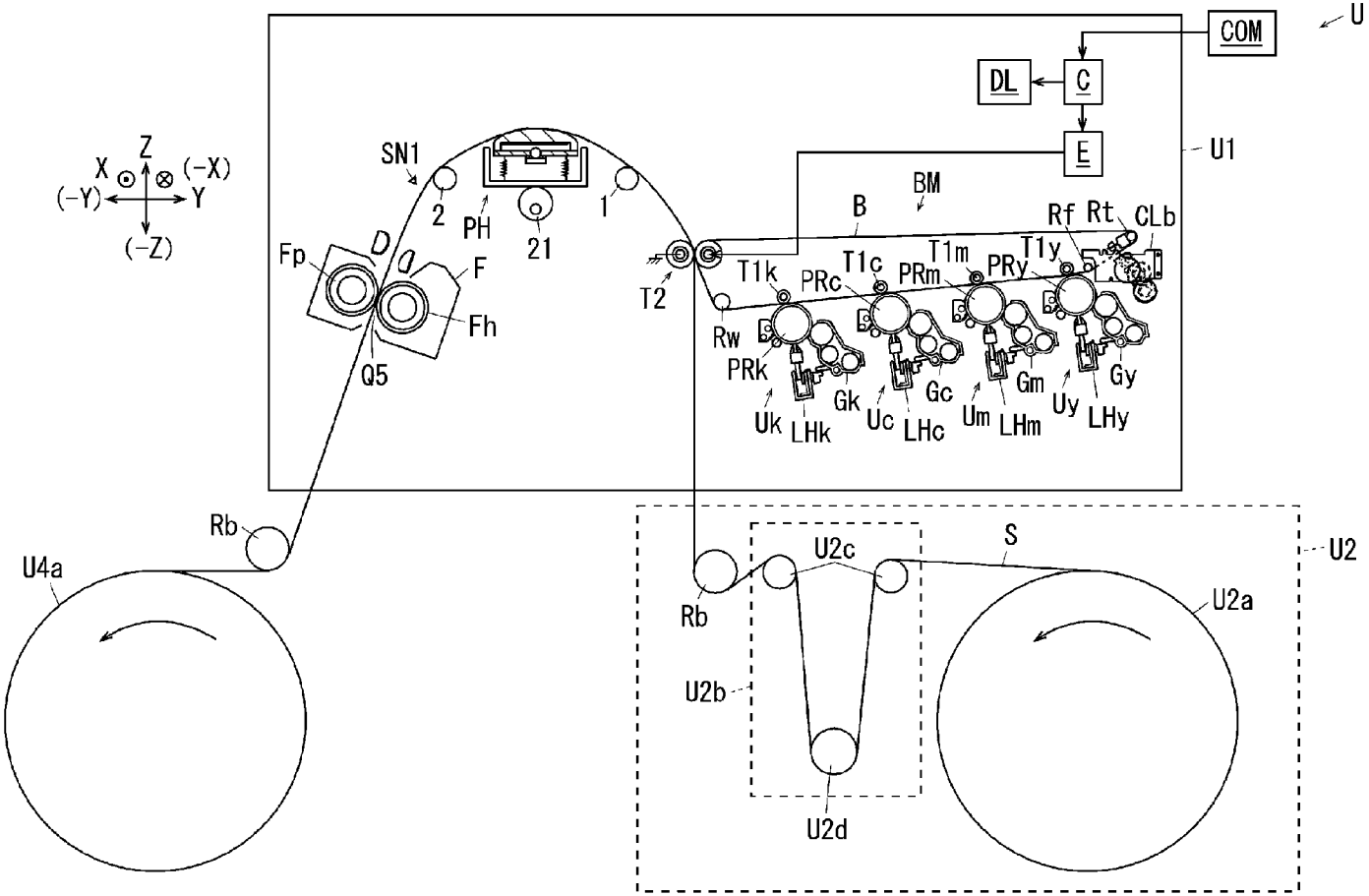
FIG. 1 illustrates an image forming apparatus according to a first exemplary embodiment.

FIG. 1 illustrates an image forming apparatus according to a first exemplary embodiment.

Figure 2:
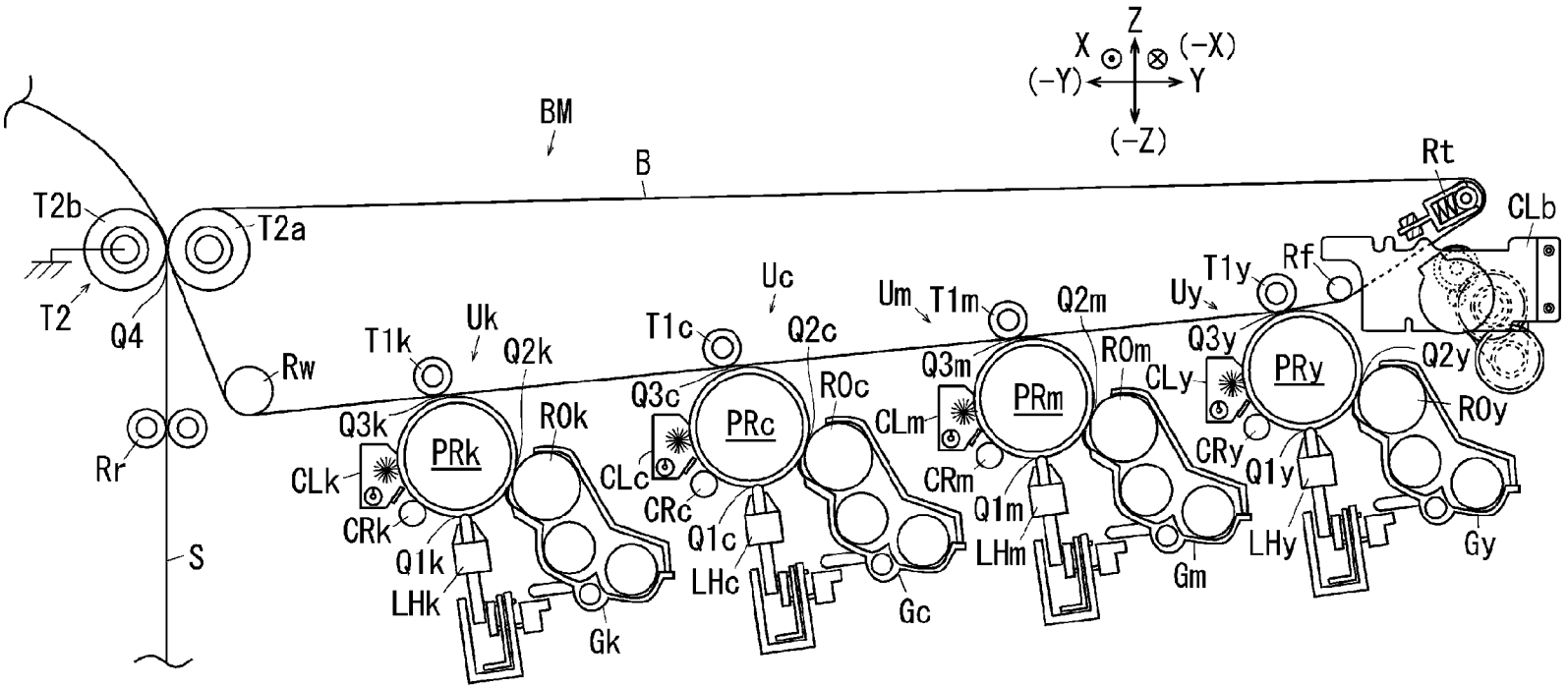
FIG. 2 illustrates a part of the image forming apparatus according to the first exemplary embodiment.

FIG. 2 illustrates a part of the image forming apparatus according to the first exemplary embodiment.

Referring to FIG. 1, a printer U, which is an example of the image forming apparatus according to the first exemplary embodiment of the present invention, includes a printer body U1, which is an example of a recording section and an example of an image forming section. The printer body U1 includes a controller C for controlling the printer U. The controller C is electrically connected to a personal computer COM, which is an example of an information transmitting apparatus. The controller C is capable of processing image information sent from the personal computer COM. The controller C is electrically connected to a writing circuit DL of the printer body U1. Referring to FIGS. 1 and 2, the writing circuit DL is electrically connected to LED heads LHy, LHm, LHc, and LHk, which are examples of a latent-image forming device and examples of an exposure device.

In the first exemplary embodiment, the LED heads LHy, LHm, LHc, and LHk respectively correspond to Y, M, C, and K colors. In the first exemplary embodiment, each of the LED heads LHy to LHk is an LED array in which LEDs, each of which is an example of a light-emitting device, are linearly arranged in the width direction of an image. The LEDs of the LED heads LHy to LHk are each capable of emitting a light beam in accordance with an input signal. That is, the LED heads LHy to LHk are each capable of outputting a writing light beam in accordance with an input signal.

Referring to FIGS. 1 and 2, photoconductors PRy, PRm, PRc, and PRk, which are examples of an image carrier, are respectively disposed above the LED heads LHy to LHk. The photoconductors PRy to PRk and the LED heads LHy to LHk respectively face each other in writing regions Q1*y*, Q1*m*, Q1*c*, and Q1*k*.

Charging rollers CRy, CRm, CRc, and CRk, which are examples of a charger, are disposed upstream of the LED heads LHy to LHk in the rotation direction of the photoconductors PRy, PRm, PRc, and PRk. In the first exemplary embodiment, the charging rollers CRy to CRk are rotated by contacting the photoconductors PRy to PRk.

Developing devices Gy, Gm, Gc, and Gk are disposed downstream of the LED heads LHy to LHk in the rotation direction of the photoconductors PRy to PRk. The photoconductors PRy to PRk and the developing devices Gy to Gk respectively face each other in developing regions Q2*y*, Q2*m*, Q2*c*, and Q2*k*.

First-transfer rollers T1*y*, T1*m*, T1*c*, and T1*k*, which are examples of a first-transfer unit, are disposed downstream of the developing devices Gy to Gk in the rotation direction of the photoconductors PRy to PRk. The photoconductors PRy to PRk and the first-transfer rollers T1*y* to T1*k* respectively face each other in first-transfer regions Q3*y*, Q3*m*, Q3*c*, and Q3*k*.

Photoconductor cleaners CLy, CLm, CLc, and CLk, which are examples of an image-carrier cleaner, are disposed are disposed downstream of the first-transfer rollers T1*y* to T1*k* in the rotation direction of the photoconductors PRy to PRk.

The photoconductor Pry, the charging roller CRy, the LED head LHy, the developing device Gy, the first-transfer roller T1*y*, the photoconductor cleaner CLy for Y color constitute an image forming unit Uy for Y color, which is an example of a visible-image forming device for Y color according to the first exemplary embodiment that forms a toner image. Likewise, the photoconductors PRm, PRc, and PRk, the charging rollers CRm, CRc, and CRk, the LED heads LHm, LHc, and LHk, the developing device Gm, Gc, and Gk, the first-transfer rollers T1*m*, T1*c*, and T1*k*, the photoconductor cleaners CLm, CLc, and CLk respectively constitute image forming units Um, Uc, and Uk for M, C, and K colors.

A belt module BM, which is an example of an intermediate transfer device, is disposed above the photoconductors PRy to PRk. The belt module BM includes an intermediate transfer belt B, which is an example of an image carrier and an example of an intermediate transfer member. The intermediate transfer belt B is an endless belt.

The intermediate transfer belt B according to the first exemplary embodiment is rotatably supported by a tension roller Rt, which is an example of a tension member; a walking roller Rw, which is an example of a displacement correcting member; an idler roller Rf, which is an example of a driven member; a backup roller T2*a*, which is an example of a second-transfer region counter member and an example of a drive member; and the first-transfer rollers T1*y*, T1*m*, T1*c*, and T1*k*.

A second-transfer roller T2*b*, which is an example of a second-transfer member, is disposed so as to face the backup roller T2*a* with the intermediate transfer belt B therebetween. In the first exemplary embodiment, to the backup roller T2*a*, the electric power circuit E applies a second-transfer voltage whose polarity is the same as that of the charge on the toner. The second-transfer roller T2*b* is grounded. The backup roller T2*a* and the second-transfer roller T2*b* constitute a second-transfer unit T2 according to the first exemplary embodiment. The second-transfer roller T2*b* and the intermediate transfer belt B are in contact with each other in a second-transfer region Q4.

A belt cleaner CLb, which is an example of an intermediate transfer member cleaner, is disposed downstream of the second-transfer region Q4 in the rotation direction of the intermediate transfer belt B.

The first-transfer rollers T1*y* to T1*k*, the intermediate transfer belt B, the second-transfer unit T2, and the like constitute a transfer device T1+T2+B according to the first exemplary embodiment.

Referring to FIG. 1, a sheet feeding device U2, which is an example of a sheet feeding section, is disposed below the image forming units Uy to Uk. The sheet feeding device U2 includes a sheet feeding member U2*a* around which a continuous sheet S, which is an example of a continuous medium, is rolled. The sheet feeding member U2*a* is rotatably supported. A tension applying unit U2*b*, which is an example of a tension applying device, is disposed on the left side of the sheet feeding member U2*a*. The tension applying unit U2*b* includes two driven rollers U2*c*, which are examples of a support member and which support the continuous sheet. A tension roller U2*d*, which is an example of a tension applying member, is disposed between the driven rollers U2*c*. The tension rollers U2*d* are in contact with the continuous sheet S and supported so as to be movable in the up-down directions. The tension roller U2*d* depresses the continuous sheet S by gravity to apply a tension to the continuous sheet S, thereby preventing a crease in the continuous sheet S.

The continuous sheet S fed from the sheet feeding device U2 passes through the second-transfer region Q4 in the printer body U1.

A preheater PH, which is an example of a heating device and an example of a preheating device, is disposed downstream of the second-transfer roller T2*b* in a transport direction in which the continuous sheet S is transported. A fixing device F is disposed downstream of the preheater PH. The fixing device F includes a heating roller Fh, which is an example of a heating member, and a pressing roller Fp, which is an example of a pressing member. A heater, which is an example of a heat source, is contained in the heating roller Fh.

A guide roller Rb, which is an example of a guide member, is rotatably supported at a position downstream of the fixing device F.

A winding roller U4*a*, which is an example of a recovery member, is disposed downstream of the guide roller Rb. The continuous sheet S is wound around the winding roller U4*a*. The winding roller U4*a* is rotated by a motor (not shown), which is an example of a drive source.

Description of Image Forming Operation

When the printer U according to the first exemplary embodiment, having the structure described above, receives image information from the personal computer COM, the printer U starts a printing operation. On the basis of the received image information, the controller C generated image information for forming latent images for yellow Y, magenta M, cyan C, and black K. The controller C outputs the generated image information to a writing circuit DL of the printer body U1. If the image is a monochrome image, the controller C outputs only the image information for black K to the writing circuit DL.

The writing circuit DL outputs control signals corresponding to the image information to the LED heads LHy to LHk. The LED heads LHy to LHk emit writing beams corresponding to the control signals.

The photoconductors PRy to PRk rotate when an image forming operation is started. The electric power circuit E applies charging voltages to the charging rollers CRy to CRk. Accordingly, the surfaces of the photoconductors PRy to PRk are charged by the charging rollers CRy to CRk. The LED heads LHy to LHk emit writing beams toward the charged surfaces of the photoconductors PRy to PRk at the writing regions Q1*y* to Q1*k* to form electrostatic latent images on the surfaces. The developing devices Gy, Gm, Gc, and Gk develop the electrostatic latent images on the photoconductors PRy to PRk into toner images, which are examples of a visible image, in the developing regions Q2*y* to Q2*k*.

The developed toner images are transported to first-transfer regions Q3*y*, Q3*m*, Q3*c*, and Q3*k*, in which the photoconductors PRy to PRk are respectively in contact with the intermediate transfer belt B. To the first-transfer rollers T1*y* to T1*k*, the electric power circuit E applies a first-transfer voltage having a polarity opposite to that of the charge of the toner. Accordingly, the first-transfer rollers T1*y* to T1*k* transfer the toner images on the photoconductors PRy to PRk to the intermediate transfer belt B. A multiple-color toner image is formed by the transfer as follows: a toner image is transferred to the intermediate transfer belt B in a first-transfer region at an upstream position, and another toner image is transferred in an overlapping manner to the intermediate transfer belt B in another first-transfer region at a downstream position.

After the first-transfer has been finished, the photoconductor cleaners CLy to CLk clean the surfaces of the photoconductors PRy to PRk by removing substances remaining on and adhering to the surfaces. The charging rollers CRy to CRk charge the cleaned surfaces of the photoconductors PRy to PRk again.

A monochrome toner image or a multiple-color toner image, which has been transferred from the first-transfer rollers T1*y* to Ilk to the intermediate transfer belt B in the first-transfer regions Q3*y* to Q3*k*, is transported to the second-transfer region Q4.

The continuous sheet S is transported downstream through the second-transfer region Q4 by receiving transport forces from the fixing device F and the winding roller U4*a*.

To the backup roller T2*a*, the electric power circuit E applies a second-transfer voltage having a polarity the same as that of the charge of the toner. Accordingly, the toner image on the intermediate transfer belt B is transferred from the intermediate transfer belt B to the recording sheet S.

After the second-transfer has been finished, the belt cleaner CLb cleans the intermediate transfer belt B by removing, for example, substances adhering to the surface of the intermediate transfer belt B.

The preheater PH heats the continuous sheet S, to which the toner image has been second-transferred, and the toner image is thermally fixed to the continuous sheet S while the continuous sheet S passes through the fixing region Q5.

The continuous sheet S, to which the image has been fixed, is wound around the winding roller U4*a*.

Description of Preheater

Figure 3:
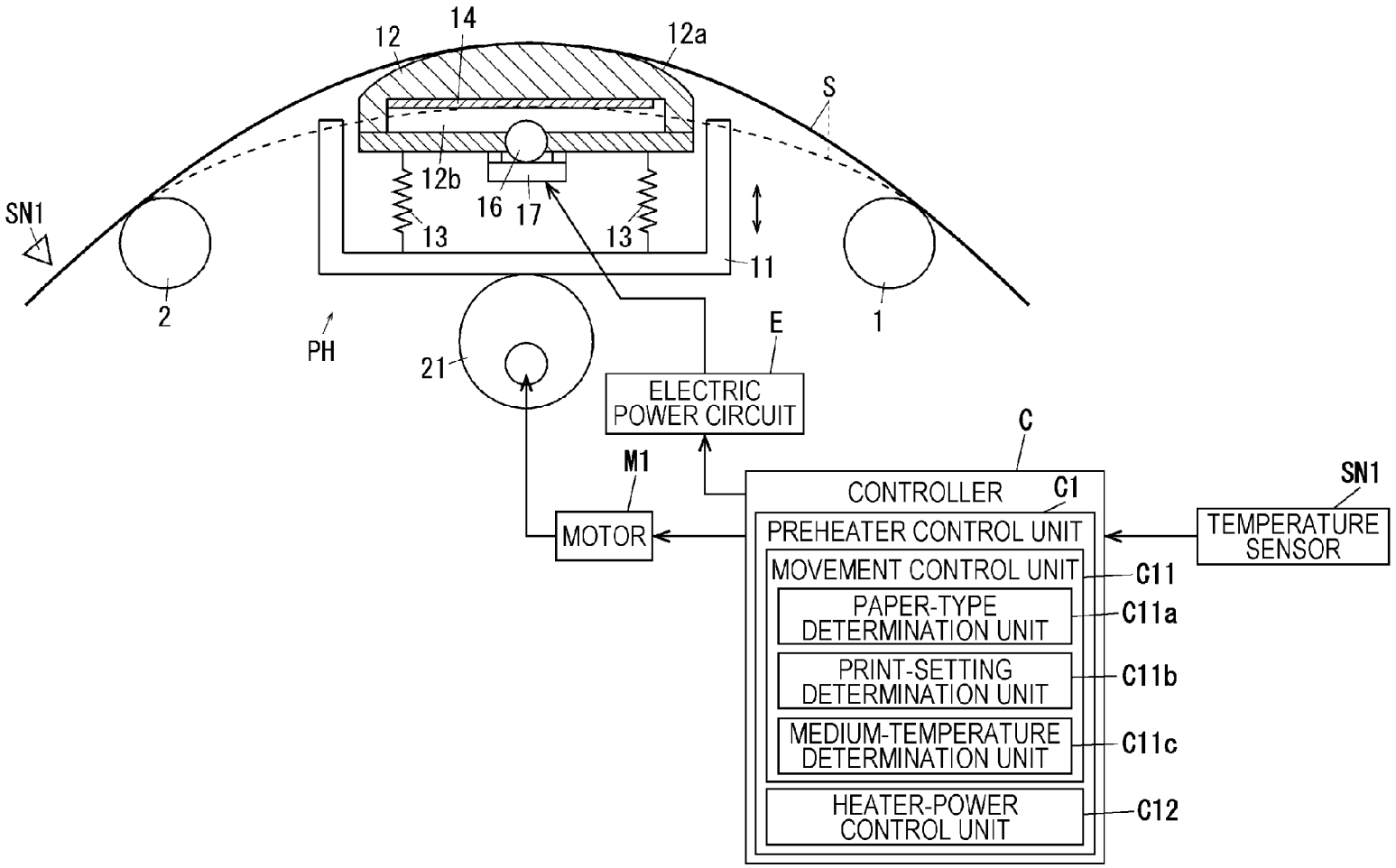
FIG. 3 illustrates a preheater of the image forming apparatus according to the first exemplary embodiment.

FIG. 3 illustrates the preheater PH of the image forming apparatus according to the first exemplary embodiment.

Figure 4:
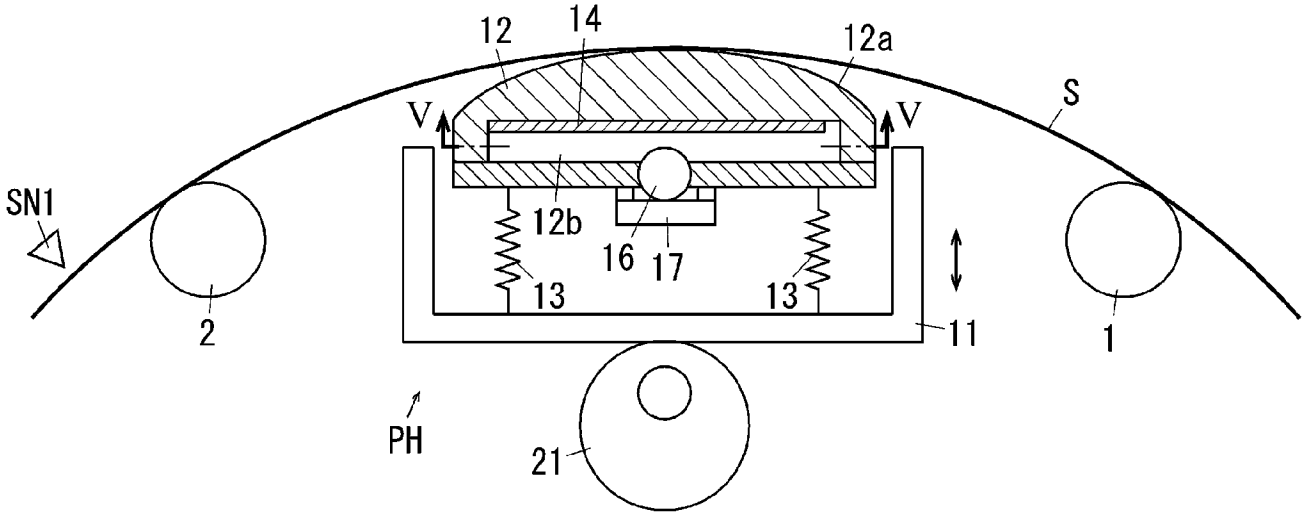
FIG. 4 illustrates the preheater according to the first exemplary embodiment located at a position at which the preheater is in contact with a continuous sheet over a smaller area than in FIG. 3.

FIG. 4 illustrates the preheater PH according to the first exemplary embodiment located at a position at which the preheater PH is in contact with the continuous sheet S over a smaller area than in FIG. 3.

Referring to FIGS. 3 and 4, in the printer U according to the first exemplary embodiment, an upstream transport roller 1, which is an example of a transport member, is disposed upstream of the preheater PH in the transport direction of the continuous sheet S. Moreover, a downstream transport roller 2, which is an example of a transport member, is disposed downstream of the preheater PH in the transport direction of the continuous sheet S. The transport rollers 1 and 2 support the continuous sheet S and guide the continuous sheet S toward the downstream side in the transport direction.

In the first exemplary embodiment, the positions of the transport rollers 1 and 2 relative to the second-transfer region Q4 and the fixing region Q5 are set so that the continuous sheet S has an upwardly convex shape not only when the preheater PH is in contact with the continuous sheet S over a larger area as illustrated in FIG. 3 but also when the preheater PH is in contact with the continuous sheet S over a smaller area as illustrated in FIG. 4. Accordingly, as shown by a broken line in FIG. 3, even when the continuous sheet S is separated from the preheater PH, the continuous sheet S is transported while keeping a predetermined curvature.

A temperature sensor SN1, which is an example of a temperature detection member, is disposed downstream of the downstream transport roller 2. The temperature sensor SN1 detects the temperature of the continuous sheet S.

Referring to FIG. 3, the preheater PH according to the first exemplary embodiment includes a housing 11, which is an example of a frame member. The housing 11 is supported by the printer body U1 so as to be movable in a direction in which the housing 11 moves closer to the continuous sheet S or in a direction in which the housing 11 moves away from the continuous sheet S. A contact plate 12, which is an example of a heating member and an example of a heating member body, is supported in the housing 11. The contact plate 12 is supported by the housing 11 so as to be movable in a direction in which the contact plate 12 moves closer to the continuous sheet S or in a direction in which the contact plate 12 moves away from the continuous sheet S. The contact plate 12 is urged by a spring 13, which is an example of an urging member, in a direction in which the contact plate 12 comes into contact with the continuous sheet S.

A contact surface 12*a*, which is an upper surface of the contact plate 12, is an upwardly convex curved surface. In the first exemplary embodiment, as shown by a broken line in FIG. 3, the curvature of the contact surface 12*a* is greater than the curvature of the continuous sheet S in a state in which the preheater PH is not in contact with the continuous sheet S.

Figure 5:
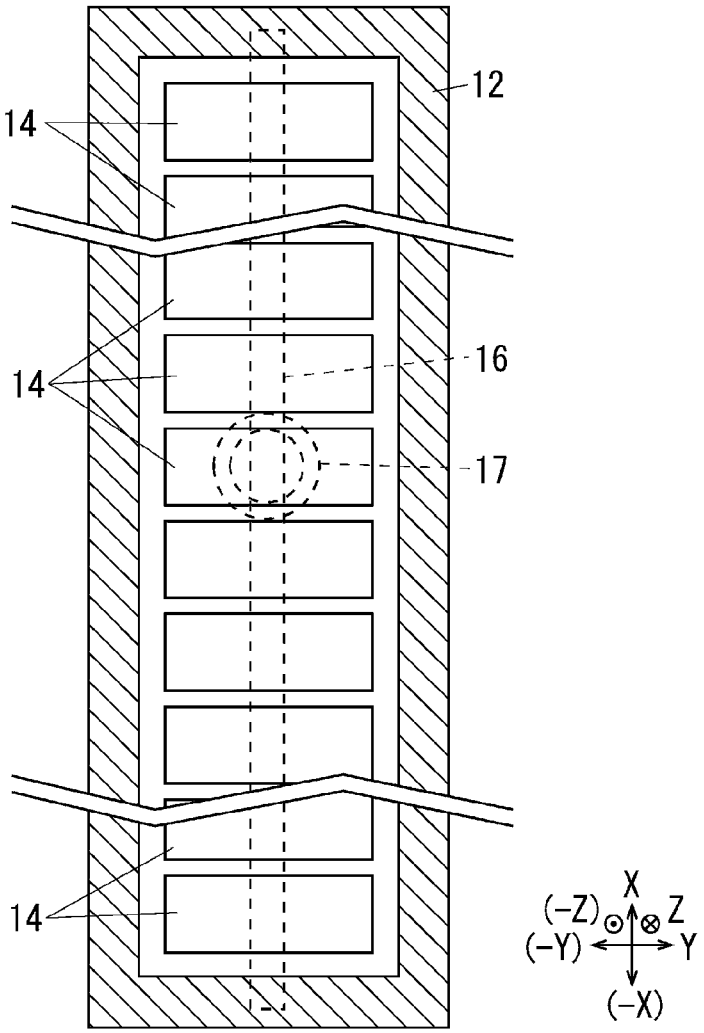
FIG. 5 illustrates a heat source of the preheater according to the first exemplary embodiment.

FIG. 5 illustrates a heat source portion of the preheater according to the first exemplary embodiment.

Referring to FIGS. 3 and 4, a heater-containing space 12*b*, which is an example of a heat-source containing portion, is formed in the contact plate 12. Heaters 14, which are examples of a heat source, are supported on the upper surface of the heater-containing space 12*b*, that is, at positions corresponding to a surface of the contact plate 12 opposite to the contact surface 12*a*.

Referring to FIG. 5, the heaters 14 according to the first exemplary embodiment are arranged in the front-back direction, which is the width direction of the continuous sheet S.

Referring to FIGS. 3 to 5, a heat pipe 16, which is an example of a heat-transfer member, is supported in a lower part of the heater-containing space 12*b*. The heat pipe 16 extends in the front-back direction, which is the width direction of the continuous sheet S. The heat pipe 16 according to the first exemplary embodiment extends to positions corresponding to the heaters 14 located at the front and back ends, and the heat pipe 16 faces all the heaters 14. The heat pipe 16 may have, for example, the following known structure: a working fluid that evaporates at a high temperature and liquefies at a low temperature is contained in a hollow cylindrical pipe, and heat is transferred as the working fluid circulates through the pipe when a temperature difference occurs in the heat pipe 16.

Referring to FIGS. 3 to 5, a thermostat 17, which is an example of an overheat prevention device, is supported at a position below a middle part of the heater-containing space 12*b* in the front-back direction. The thermostat 17 according to the first exemplary embodiment is disposed so as to be in contact with the heat pipe 16. In the first exemplary embodiment, one thermostat 17 is disposed at a position corresponding to a middle part of the continuous sheet S in the width direction. In the first exemplary embodiment, the electric power circuit E is electrically connected to the thermostat 17, and the thermostat 17 is connected to the heaters 14. Accordingly, in the first exemplary embodiment, the electric power circuit E supplies electric power to the heaters 14 not directly but via the thermostat 17. The thermostat 17 according to the first exemplary embodiment is a known component that stops supply of electric power if the temperature exceeds a predetermined temperature.

Referring to FIGS. 3 and 4, an eccentric cam 21, which is an example of a movement unit and a movement member, is disposed below the housing 11 of the preheater PH according to the first exemplary embodiment. The eccentric cam 21 is rotated by a motor Ml. As the eccentric cam 21 rotates, the housing 11, the contact plate 12, and the like move up or move down, that is, move in a direction in which they move closer to the continuous sheet S or in a direction in which they move away from the continuous sheet S. Accordingly, the preheater PH according to the first exemplary embodiment moves between a first position shown in FIG. 3, at which the contact surface 12*a* is in contact with the continuous sheet S over a larger area, and a second position shown in FIG. 4, at which the contact surface 12*a* is in contact with the continuous sheet S over a smaller area than at the first position. In the first exemplary embodiment, when moving from the first position shown in FIG. 3 to the second position shown in FIG. 4, the housing 11 and the like move downward due to their own weights.

The members denoted by numerals 11 to 21 constitute the preheater PH according to the first exemplary embodiment.

Description of Controller

Referring to FIG. 3, the controller C controls the preheater PH according to the first exemplary embodiment.

The controller C of the printer U includes an I/O interface through which a signal is input or output between the printer U and the outside. The controller C includes a read-only memory (ROM), which stores programs and data for executing necessary processes. The controller C includes a random-access memory (RAM), which temporarily stores necessary data. The controller C includes a processor (CPU) for executing programs stored in the ROM and the like. Accordingly, the controller C according to the first exemplary embodiment is a small information processing device, that is, a microcomputer. Thus, the controller C is capable of performing various functions by executing the programs stored in the ROM and the like.

Referring to FIG. 3, the controller C includes a preheater control unit C1 that controls the up/down movement of the preheater PH and the supply of electric power to the heaters 14.

A movement control unit C11 includes a sheet-type determination unit C11*a*, a print-setting determination unit C11*b*, and a medium-temperature determination unit C11*c*.

The sheet-type determination unit C11*a* determines the type of the continuous sheet S. On the basis of information input from a user interface (not shown), which is an example of an input unit, the sheet-type determination unit C11*a* according to the first exemplary embodiment determines whether or not the basis weight or the ream weight of the continuous sheet S is greater than or equal to a predetermined value and whether or not the material of the continuous sheet S is a resin film.

The print-setting determination unit C11*b* determines the print settings of the printer U. The print-setting determination unit C11*b* according to the first exemplary embodiment determines whether the print settings are those for a full-color mode, which uses the four color developers, or those of a monochrome mode, which uses only the K color developer, on the basis of print-setting information included in image information received from the personal computer COM. The print-setting determination unit C11*b* according to the first exemplary embodiment also determines whether or not the print settings include a high-gloss setting.

The medium-temperature determination unit C11*c* determines the temperature of the continuous sheet S. The medium-temperature determination unit C11*c* according to the first exemplary embodiment determines whether or not the temperature of the continuous sheet S is higher than or equal to a predetermined temperature by indirectly estimating the temperature of the continuous sheet S on the basis of a detection result of the temperature sensor SN1.

If the basis weight or the ream weight of the continuous sheet S is greater than or equal to a predetermined value, the movement control unit C11 according to the first exemplary embodiment moves the preheater PH to the first position. If the continuous sheet S is a film, the movement control unit C11 moves the preheater PH to the first position. If the print settings are those for the full-color mode or if the print setting includes the high-gloss setting, the movement control unit C11 moves the preheater PH to the first position. If the temperature of the continuous sheet S is lower than a predetermined temperature, the movement control unit C11 moves the preheater PH to the first position. Accordingly, in the first exemplary embodiment, the following conditions are preset as the heating conditions for increasing the area of contact: a condition that the basis weight or the like is greater than or equal to a predetermined value; a condition that the print mode is the full color mode; a condition that the print settings include a high-gloss setting; a condition that the continuous sheet is a film; and a condition that the temperature of the continuous sheet is low. If none of these conditions is satisfied, the movement control unit C11 moves the preheater PH to the second position.

The heater-power control unit C12 controls the electric power circuit E to control the supply of electric power to the heaters 14. The heater-power control unit C12 according to the first exemplary embodiment supplies electric power to the heaters 14 in accordance with the width of the continuous sheet S, which is input from the user interface. That is, the heater-power control unit C12 supplies electric power to some of the heaters 14 that are disposed inside the width of the continuous sheet S; and does not supply electric power to the other heaters 14 that are disposed outside of the width of the continuous sheet S. In the first exemplary embodiment, in order to control the temperature of the contact surface 12*a* at a predetermined temperature, the heater-power control unit C12 turns on or off the heaters 14 while measuring the temperature of the contact surface 12*a* by using a thermometer (not shown). The temperatures of the heaters 14 of the preheater PH are controlled to be lower than that of the heater of the fixing device F. To be specific, the temperatures of the heaters 14 are set so that the continuous sheet S is heated to such a temperature at which the developer does not completely melt but partially melt (part of the developer is melt but most of the developer is not melt) at the position of the preheater PH. In the first exemplary embodiment, for example, when using a developer that melts at about 100° C., the temperature of the heater of the fixing device F is set at 180° C. so that the temperature of the fixing region Q5 becomes higher than or equal to 100° C. The control temperatures of the heaters 14 of the preheater PH are set in the range of 100° C. to 120° C., so that the temperature of the contact surface 12*a* becomes about 80° and the developer does not melt or partially melt (becomes soft) at the position of the preheater PH. In general, a halogen lamp is used as a heat source.

However, the heat source is not limited to a halogen lamp. For example, a planar heater, such as a ceramic heater, may be used.

Function of Preheater

In the printer U according to the first exemplary embodiment, having the structure described above, the continuous sheet S passes the position of the preheater PH before the fixing device F fixes an image to the continuous sheet S. The preheater PH is moved in accordance with the type of the continuous sheet S, print settings, and temperature.

With existing technologies, a preheating member is in contact with a continuous sheet while an image forming operation is performed, and the preheating member is separated from the continuous sheet when the image forming operation is finished. In this case, if the continuous sheet is thick, the amount of heat may be insufficient, and, if the continuous sheet is thin, the amount of heat may be excessive. That is, if the continuous sheet is thin, fixing failure may occur due to insufficient amount of heat in a fixing device, and, if the continuous sheet is thin, the continuous sheet may become damaged due to excessive heat. In winter, the temperature of the continuous sheet is low and the amount of heat may be insufficient, and, in summer, the temperature of the continuous sheet is high and the amount of heat may be excessive. In particular, there is a case where, instead of a roller that rotates while being in contact with the continuous sheet, a contact plate, which slides over the surface of a continuous sheet, is used as a contact member that contacts the continuous sheet. In this case, if the continuous sheet is thin, a large load is applied to the continuous sheet when the contact plate slides, and the continuous sheet may become damaged.

In contrast, with the first exemplary embodiment, if the basis weight or the like of the continuous sheet S is large, that is, if the continuous sheet S is thick, the contact surface 12*a* contacts the continuous sheet S over a larger area, and, if the continuous sheet S is thin, the contact surface 12*a* contacts the continuous sheet S over a smaller area. Thus, compared with existing technologies, the occurrence of insufficiency in the amount of heat when the continuous sheet S is thick is reduced, and the occurrence of damage to the continuous sheet S when the continuous sheet S is thin is reduced. Moreover, a load generated as the contact plate 12 slides over the continuous sheet S is reduced, and therefore the occurrence of damage to the continuous sheet S when the continuous sheet is reduced.

In the first exemplary embodiment, the area of contact between the contact surface 12*a* and the continuous sheet S in a full color mode is larger than that in a monochrome mode. Accordingly, in the full color mode, in which the amount of developer is usually larger than that in the monochrome mode, the occurrence of fixing failure due to insufficient amount of heat is reduced. If the print settings include a high-gloss setting, the area of contact between the continuous sheet S and the contact surface 12*a* is increased, so that the amount of heat applied to the continuous sheet S and the developer is increased.

Moreover, with the first exemplary embodiment, if the print settings include a low-gloss setting, the area of contact between the continuous sheet S and the contact surface 12*a* is increased, compared with a case where the print setting include a high-gloss setting. When a surface of the continuous sheet S opposite to a surface to which the developer has been transferred is heated, the temperatures of the continuous sheet S and the developer do not easily decrease after the continuous sheet S has passed through the fixing region Q5, and a melted state of the developer is likely to be maintained for a long time. Accordingly, compared with a case where the preheater PH does not apply heat to the continuous sheet S, the surface of the developer tends to become nonuniform as the developer cools and solidifies in an unpressed state, and the gloss tends to decrease. Therefore, with the first exemplary embodiment, if the print settings include a low-gloss setting, the area of contact between the continuous sheet S and the contact surface 12*a* is increased, and, if the print settings include a high-gloss setting, the area of contact is decreased. Accordingly, the occurrence of an image defect related to the gloss setting is reduced.

With the first exemplary embodiment, if the continuous sheet S is a film, compared to other cases, the area of contact between the continuous sheet S and the contact surface 12*a* is increased. Accordingly, when a film, having a large heat capacity, is used, the occurrence of fixing failure due to insufficient amount of heat is reduced.

With the first exemplary embodiment, if the temperature of the continuous sheet S is low, compared with a case where the temperature is high, the area of contact between the continuous sheet S and the contact surface 12*a* is increased. Thus, before the continuous sheet S is transported to the fixing region Q5, the amount of heat applied by the preheater PH to the continuous sheet S and the developer is adjusted. Accordingly, the occurrence of fixing failure due to insufficient amount of heat in the fixing region Q5 is reduced.

With the preheater PH according to the first exemplary embodiment, the curvature of the contact surface 12*a* is greater than the curvature of the continuous sheet S. For example, if the contact surface is a horizontal planar surface or the curvature of the contact surface is small, only the both ends of the contact plate 12 contact the continuous sheet S. Accordingly, the area of contact between the continuous sheet S and the contact plate 12 is small, and heat is not easily applied to the continuous sheet S. Moreover, if only the left and right corners contact the continuous sheet S, the continuous sheet S may become damaged. In contrast, with the first exemplary embodiment, the curvature of the contact surface 12*a* is large, so that the contact surface 12 is capable of contacting the continuous sheet S over a large area. Thus, compared with a case where the curvature of the contact surface is small, the occurrence of fixing failure due to insufficient amount of heat applied to the continuous sheet S is reduced. Moreover, a corner of the contact surface 12*a* according to the first exemplary embodiment is not likely to contact the continuous sheet S, so that damage to the continuous sheet S is reduced.

The preheater PH according to the first exemplary embodiment includes the plural heaters 14, which are arranged in the width direction, and only some of the heaters 14 corresponding to the width of the continuous sheet S generate heat by being supplied with electric power. Accordingly, compared with a case where all of the heaters 14 generate heat, the electric power consumption is reduced.

With existing technologies, each heater includes an overheat prevention device. In this case, the number of overheat prevention devices increases as the number of heaters increases. Accordingly, a problem arises in that the number of components increases and the manufacturing cost increases. On the other hand, if the number of overheat prevention devices is reduced relative to the number of heaters, the distances between the heaters and the overheat prevention devices vary. In this case, the overheat prevention devices may fail to detect overheating of distant heaters, or may detect erroneously that nearby heaters are overheated.

In contrast, in the first exemplary embodiment, the heat pipe 16 is disposed so as to cover all of the heaters 14, and the thermostat 17 is in contact with the heat pipe 16. Accordingly, even from the heaters 14 distanced from the thermostat 17, heat is transferred to the heat pipe 16 due to radiation of heat from the heaters 14 or transfer of heat through the contact plate 12, and heat is the smoothly transferred to the thermostat 17 through the heat pipe 16. Thus, even though the number of the thermostat 17 is small relative to the number of the heaters 14, it is possible to detect excessive increase of the temperatures of the heaters 14 and to stop supply of electric power if excessive heating occurs. Thus, it is possible to reduce the number of the thermostats 17 compared with existing technologies.

Second Exemplary Embodiment

Figure 6A:
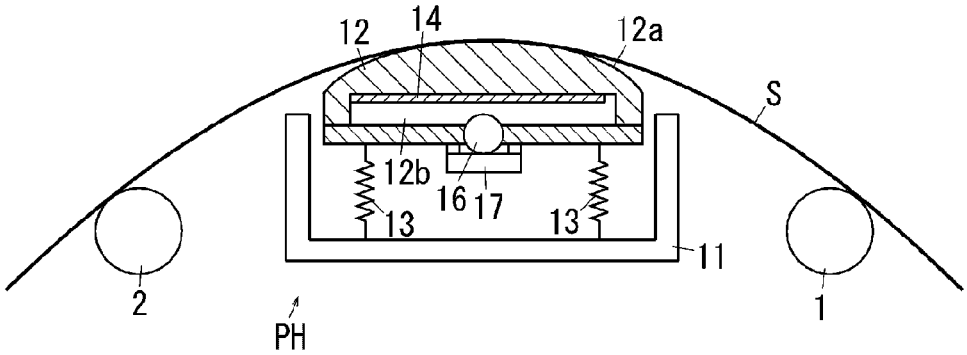
FIG. 6A illustrates a preheater according to a second exemplary embodiment in a state in which the preheater is in contact with the continuous sheet.
Figure 6B:
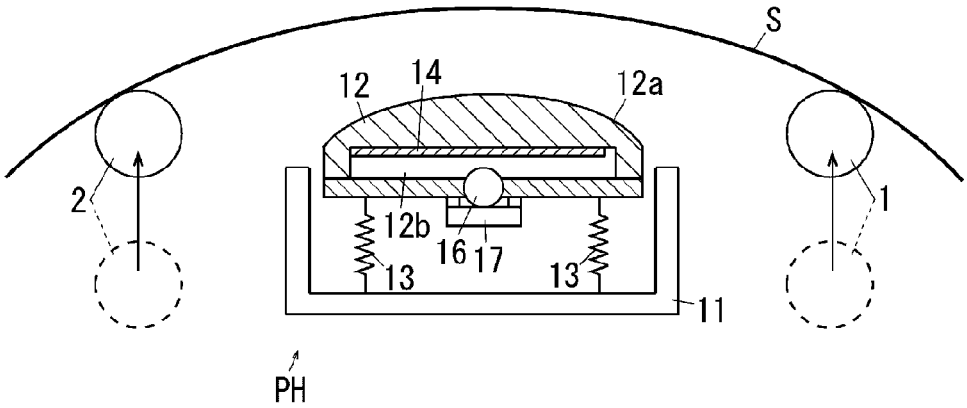
FIG. 6B illustrates the preheater in a state in which the preheater is separated from the continuous sheet.

FIG. 6A illustrates a preheater according to a second exemplary embodiment in a state in which the preheater is in contact with the continuous sheet, and FIG. 6B illustrates the preheater in a state in which the preheater is separated from the continuous sheet.

In the following description of the second exemplary embodiment of the present invention, elements of the second exemplary embodiment that are the same as those of the first exemplary embodiment will be denoted by the same numerals, and detailed descriptions of such elements will be omitted.

The second exemplary embodiment differs from the first exemplary embodiment only in the following respect, and is the same as the first exemplary embodiment in other respects.

Referring to FIG. 6, a printer U according to the second exemplary embodiment differs from that of the first exemplary embodiment in that the housing 11 is fixed to the printer body U1 and the printer U does not include the eccentric cam 21. On the other hand, in the second exemplary embodiment, the transport rollers 1 and 2, which are examples of a movement unit, are movable in the up-down directions. In the second exemplary embodiment, when increasing the area of contact between the continuous sheet S and the contact surface 12*a*, the transport rollers 1 and 2 move downward to the position shown in FIG. 6A. When decreasing the area of contact, the transport rollers 1 and 2 move upward to the position shown in FIG. 6B.

Operational Effect of Second Exemplary Embodiment

As with the first exemplary embodiment, with the printer U according to second exemplary embodiment, having the structure described above, the area of contact between the continuous sheet S and the contact surface 12*a* is changed in accordance with the type of the continuous sheet S, print settings, and temperature. Accordingly, as with the first exemplary embodiment, the occurrences of fixing failure due to insufficient amount of heat and damage to the continuous sheet S are reduced.

Modifications

The present invention is not limited to the exemplary embodiments described above, and the exemplary embodiments may be modified in various ways within the sprit and scope of the present invention described in the claims. Examples of the modifications include the following (H01) to (H010).

(H01) In the exemplary embodiments, the printer U is used as an example of an image forming apparatus. However, this is not a limitation. For example, the image forming apparatus may be a copier, a facsimile machine, or a multifunctional machine having some or all of printing, copying, and facsimile functions.

(H02) In the exemplary embodiments, the printer U uses four color developers. However, this is not a limitation. The image forming apparatus may use a monochrome developer, three color developers, or five or more color developers.

(H03) In the exemplary embodiments, the number of the thermostat 17 is one. However, this is not a limitation. For example, two thermostats 17 may be disposed at both ends, or three thermostats 17 may be disposed at both ends and at the center. The number of thermostats 17 may be changed as appropriate, provided that the number of thermostats 17 is smaller than the number of the heaters 14.

(H04) In the exemplary embodiments, the contact plate 12 is used as an example of a member that contacts the continuous sheet S. However, this is not a limitation. Alternatively, for example, a rotatable roller or a rotatable belt may be used. Preferably, the contact surface 12*a* has a large curvature. However, the contact surface 12*a* may have a small curvature or may be planar.

(H05) In the first exemplary embodiment, the eccentric cam 21 is used as an example of a member that moves the preheater PH closer to or away from the continuous sheet S. However, this is not a limitation. For example, as appropriate, any moving mechanism, such as a mechanism including a solenoid or a sliding mechanism using rack and pinion, may be used.

(H06) In the first exemplary embodiment, the preheater PH only moves between a position at which the area of contact with the continuous sheet S is large and a position at which the area of contact with the continuous sheet S is small; and the preheater PH does not become separated from the continuous sheet S. In the second exemplary embodiment, the preheater PH moves between a position at which the preheater PH contacts the continuous sheet S and a position at which the preheater PH is separated from the continuous sheet S. However, this is not a limitation. For example, the first exemplary embodiment and the second exemplary embodiment may be used in combination so that the preheater PH moves between three positions, including a position at which the area of contact is large, a position at which the area of contact is small, and a position at which the preheater is separated from the continuous sheet S. Further, the area of contact may be changed among more than three values by increasing the number of stop positions of the eccentric cam 21.

(H07) In the exemplary embodiments, sheet type, print settings, and temperature are used as parameters for changing the area of contact between the preheater PH and the continuous sheet S. However, this is not a limitation. Additional parameters may be used, or one of or some of the aforementioned parameters need not be used. In the exemplary embodiments, if the print settings include a low-gloss setting, the preheater PH is moved to the first position. However, with some image forming apparatuses, depending on the particle diameter or the melting temperature of the developer, a high-gloss image is formed when the area of contact is large. In such a case, in contrast to the first exemplary embodiment, the preheater PH may be moved to the first position if the print settings include a high-gloss setting. That is, the first position and the second position may be switched over, depending on the structure, the design, the specifications, and the like of the image forming apparatus.

(H08) In the exemplary embodiments, the heat pipe 16 is used as an example of a heat transfer member. However, this is not a limitation. For example, as appropriate, any heat transfer member that is made of a metal having high thermal conductivity, such as silver (Ag), copper (Cu), gold (Au), aluminum (Al); an alloy of such metals; or a resin may be used.

(H09) In the exemplary embodiments, preferably, the preheater PH moves due to its own weight. However, this is not a limitation. Without using own weight, the preheater PH may be moved by using a spring, an additional eccentric cam, or the like.

(H010) In the exemplary embodiments, a thermostat is used as an example of an overheat prevention device. However, this is not a limitation. For example, any known overheat prevention device, such as a fuse, that is capable of stopping supply of electric power if temperature becomes higher than a predetermined temperature may be used.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A preheating device for heating a continuous medium that is continuous in a transport direction in which the continuous medium is transported, the preheating device being disposed upstream of a fixing device in the transport direction, the fixing device fixing an image, which has been transferred to the continuous medium, to the continuous medium, the preheating device comprising:

a heating member having a heater-containing space, wherein the heating member is configured to heat the continuous medium by using heat supplied from a heat source, the heating member contacting one surface of the heat source; and a movement unit comprising a cam or a pair of transport members, wherein the movement unit is configured to move one of the continuous medium and the heating member in a direction in which the continuous medium and the heating member move relatively closer to each other or in a direction in which the continuous medium and the heating member move relatively away from each other, wherein all of the heat source is disposed in the heater-containing space, wherein, on the basis of predetermined heating conditions, the movement unit is configured to move one of the continuous medium and the heating member in the direction in which the continuous medium and the heating member move relatively closer to each other if the heating conditions are satisfied, and the movement unit is configured to move one of the continuous medium and the heating member in the direction in which the continuous medium and the heating member move relatively away from each other if the heating conditions are not satisfied, wherein the heater-containing space comprises the heat source supported at an upper portion of the heater-containing space, and a heat transfer member supported at a lower portion of the heater-containing space, and wherein the heat transfer member comprises a fluid.

2. The preheating device according to claim 1, wherein the heating member has a contact surface that is configured to contact the continuous medium and that has a predetermined curvature.

3. The preheating device according to claim 2, further comprising:

the pair of transport members, one of the pair of transport members being disposed upstream and another of the pair of transport members being disposed downstream of the heating member in the transport direction of the continuous medium, wherein the pair of transport members is configured to transport the continuous medium so that the continuous medium is transported while keeping a predetermined curvature, wherein the curvature of the contact surface of the heating member is greater than a curvature of the continuous medium in a state in which the heating member is not in contact with the continuous medium.

4. The preheating device according to claim 1, further comprising:

the pair of transport members, one of the pair of transport members being disposed upstream and another of the pair of transport members being disposed downstream of the heating member in the transport direction of the continuous medium, wherein the pair of transport members is configured to transport the continuous medium so that the continuous medium is transported while keeping a predetermined curvature, wherein the heating member has a contact surface that is configured to contact the continuous medium and that has a curvature greater than a curvature of the continuous medium in a state in which the heating member is not in contact with the continuous medium.

5. An image forming apparatus comprising:

an image carrier;

a transfer device that transfers an image on the image carrier to a continuous medium;

a fixing device that fixes the image to the continuous medium; and the preheating device according to claim 1 that is disposed between the transfer device and the fixing device and that heats the continuous medium.

6. The preheating device according to claim 1, wherein all of the heater-containing space is disposed within the heating member.

7. The preheating device according to claim 1, wherein the heat transfer member is supported below the heat source.

8. The preheating device according to claim 7, wherein the heat transfer member extends in a width direction of the continuous medium and is disposed across from the heat source.

9. The preheating device according to claim 1, wherein the heater-containing space is defined by the heating member.

* * * * *